US005265685A

United States Patent [19]

Keith et al.

[11] Patent Number: 5,265,685

[45] Date of Patent: Nov. 30, 1993

[54] DRILL BIT WITH IMPROVED INSERT CUTTER PATTERN

[75] Inventors: Carl W. Keith; Ed R. Martin, Jr., both of Spring, Tex.

[73] Assignee: Dresser Industries, Inc., Dallas, Tex.

[21] Appl. No.: 815,289

[22] Filed: Dec. 30, 1991

[51] Int. Cl.[5] ..... E21B 10/46; E21B 10/58

[52] U.S. Cl. ..... 175/431; 175/432

[58] Field of Search ..... 175/378, 393, 428, 430, 175/431, 432

[56] References Cited

U.S. PATENT DOCUMENTS

| | | | |
|---|---|---|---|
| 2,093,045 | 9/1937 | Hammer | 175/404 |
| 2,729,427 | 1/1956 | Davis et al. | 175/405.1 |
| 3,106,973 | 10/1963 | Christensen | 175/413 |
| 4,186,628 | 2/1980 | Bonnice | 76/108.2 |
| 4,202,419 | 5/1980 | Youngblood | 175/431 X |
| 4,323,130 | 4/1982 | Dennis | 175/429 |
| 4,359,112 | 11/1982 | Garner et al. . | |
| 4,440,247 | 4/1984 | Sartor | 175/393 |
| 4,471,845 | 9/1984 | Jurgens | 175/431 |
| 4,602,691 | 7/1986 | Weaver | 175/430 |
| 4,907,662 | 2/1990 | Deane . | |
| 4,932,484 | 6/1990 | Warren et al. | 175/431 |
| 4,981,184 | 1/1991 | Knowlton et al. | 175/429 |

FOREIGN PATENT DOCUMENTS

| | | | |
|---|---|---|---|
| 659574 | 3/1963 | Canada | 175/431 |
| 2086451 | 5/1982 | United Kingdom | 175/431 |

OTHER PUBLICATIONS

SPE 19572, "Development of a Whirl-Resistant Bit", T. M. Warren, J. F. Brett, and L. A. Sinor, Amoco Production Co. 1989.

*Primary Examiner*—David J. Bagnell

[57] ABSTRACT

A fixed cutting element drill bit is provided with primary cutting elements which are spaced radially from each other across the face of the bit. During drilling, the gap between the cutting elements causes a ridge to be formed in the bottom of the well and the apex of the ridge is removed before reaching the face of the bit. In one form of the invention, the apex is broken off by utilization of the sides of the supports for the primary cutting elements.

18 Claims, 3 Drawing Sheets

DRILL BIT WITH IMPROVED INSERT CUTTER PATTERN

BACKGROUND OF THE INVENTION

1. Technical Field

This invention relates generally to drill bits of the type used in drilling through the material comprising a rock formation such as for an oil well or the like. More particularly, this invention is concerned with a fixed cutter bit of the type which, for example, utilizes polycrystalline diamond cutting elements protruding from the face of the bit to cut through the formation material.

BACKGROUND INFORMATION

In drilling a borehole in the earth such as for the recovery of oil or for other purposes, many different types of drill bits have been used. The choice of the appropriate type of bit to be used depends upon many factors. One of the most important of these factors to be taken into consideration is the range of hardnesses that will be encountered during transitional drilling that is when drilling through layers of differing formation harnesses.

Different types of bits work more efficiently against different formation harnesses. For example, roller cone bits are efficiently and effectively used in drilling through formation materials that are of medium to hard hardness. The mechanism for drilling with a roller cone bit is primarily a crushing and gouging action in that the inserts of the rotating cones are impacted against the formation material compressing the material beyond its compressive strength and thereby drilling through the formation. For harder materials, the mechanism for drilling changes from crushing to abrasion.

One form of a prior art fixed cutter bit for use in hard material formations is shown in U.S. Pat. No. 2,729,427. This patent teaches the use of natural diamond granules embedded in the matrix of the bit body at its face. Specifically, the granules are arranged in annular ridges which are spaced radially from each other with interposed valleys absent of granules. As described in U.S. Pat. No. 2,729,427, the drilling action resulting from this structure is a combination of abrasion and fracturing of the hard formation material. The diamond granules scour or abrade away concentric grooves while the rock formation adjacent the grooves is fractured and the matrix material around the diamond granules is worn away.

A somewhat similar prior bit also for use in drilling hard formation material is shown in U.S. Pat. No. 3,106,973 disclosing the use of replaceable and adjustable blades mounted on and protruding from the body of the bit. Each of the blades is comprised of radially spaced sections of diamonds or diamond like cutting elements embedded in a matrix. The body of the blade is of a softer material than the diamond impregnated matrix sections and includes arcuate grooves between radially increasingly larger area matrix sections. In service use, the increasing areas of the matrix sections grind at a uniform rate against the formation material while the softer material in the blade body wears away more quickly with the result that ridges are formed in the bottom of the well bore. The ribs are thought to improve the centering stability of the rotating bit and are purposefully kept thin enough for even hard formation material to break down or off by themselves to be washed away with drilling fluid.

The fixed cutter drill bits of the foregoing character are not particularly well suited for use in softer formations because not only do they inherently drill at low penetration rates but their drilling surfaces containing the diamond or diamond like cutting elements may be easily clogged with less brittle formation material. As a result, when drilling from a hard formation material and into a softer formation material the penetration rate may actually drop over that which may be achieved in harder formation materials.

For the drilling of formation materials in the soft to medium range, another type of mechanism for drilling may be employed. An example of a bit which is particularly designed for stabilized drilling is shown in U.S. Pat. No. 4,932,484. The bit disclosed in this patent utilizes radial sets of cutting elements mounted within supports to protrude from the face of the bit. At least one of the sets of cutting elements extends outward a greater distance from the face of the bit than other cutting elements so that during drilling a bit stabilizing annular groove is formed in the formation material by the extended elements. In rotated profile, the cutting elements overlap each other upon progressing radially outward from the rotational axis of the bit so that all of the formation material across the face of the drill bit is cut.

In contrast to the prior art bits shown in U.S. Pat. Nos. 2,729,427 and 3,106,973 wherein the drilling mechanism is disclosed as being by abrasion and fracturing and the like, the drilling elements or cutters disclosed in U.S. Pat. No. 4,932,484 employ a shearing action to drill through the formation material. Specifically, a sharp aggressive cutting edge on each of the cutters is pushed into the bottom of the borehole as the bit is rotated. The actual mechanics of round polycrystalline diamond cutters of this type when used in soft and medium-soft range formations may be described as a shearing action wherein formation material is removed in layers. Thus, with a bit like the one disclosed in U.S. Pat. No. 4,932,484 it may be envisioned that with each revolution of the bit, a layer of formation material having a contour matching that of the cutters is sheared from the bottom of the borehole, depending upon the depth to which the cutting edges of the cutters penetrate the formation for the amount of weight which is applied through the drilling string upon the bit.

Another form of fixed cutter bit which is taught to be usable in medium-soft to medium formations is shown in U.S. Pat. No. 4,602,691. This bit is disclosed as including sharp triangular and blunt circular cutting elements in overlapped protruding profile from the face of the bit. Specifically, the triangular elements protrude 0.005 inch farther from the face of the bit than the circular elements and, thus cut small relief kerfs in the formation. The circular elements follow thereafter and dislodge the formation between the kerfs.

Because the cost of drilling a borehole is a direct function of the length of time it takes to reach the depth desired, it is always desirable to have bits which drill faster and longer and which are usable over a wider range of differing formation material harnesses. Thus, there exists a need for a bit which is suitable for use in transitional drilling so that the drill string need not be pulled when the hardness of the material changes from a relatively soft to a harder material.

SUMMARY OF THE INVENTION

The general aim of the present invention is to provide a novel fixed cutter bit for use drilling through different formation materials which bit has longer service life and increased penetration rate over a wider range of different formation material harnesses.

The primary aim of the present invention is to provide a new and improved polycrystalline diamond drill bit having a service life for use in hard formations expanded to an acceptable length of time. A more particular object of the present invention is to accomplish the foregoing through the use of a novel pattern or spacing relationship between the cutting element cutting edges of the bit so that when drilling, the formation material is cut and fractured in a special configuration whereby the cutting elements and the cut portions of the formation act together to stabilize the bit against lateral movement and thereby avoid destruction of the cutting edges.

In accordance with a preferred novel aspect of the invention the primary cutting elements of the bit are arranged in radially spaced groups comprised of one or more elements and, most importantly, in rotated profile, the cutting edges of the elements from one group to the next are spaced radially from each other leaving a gap in the cutting edge profile. As a result, when drilling with the bit, the portion of the formation which is aligned axially with the gap remains uncut as the bit progresses through the formation leaving a ridge protruding between the groups of cutting elements.

Invention also resides in the novel manner of keeping the uncut formation portions or ridges from interfering with the flow of drilling fluid across the face of the bit by removal of the apex of the ridge without use of the cutting edges of the primary cutting elements and before the apex reaches the face of the bit to cut off such fluid flow.

In a related aspect of the present invention, one alternative for removal of the apexes of the ridges is provision of unique and much smaller secondary cutting elements which are disposed entirely within the gaps between the groups of primary cutting elements. In another and perhaps preferable alternative for removal of the apexes, portions of the supports for the primary cutting elements may be utilized in removing the apexes of the ridges in a non-cutting action.

An alternative novel aspect of the present invention lies in uniquely positioning the cutting edges within a rotated profile paralleling the face of the bit and with such edges having extended radial spans and predetermined axial lengths relative to each other. As a result when starting to drill the edges are loaded coincidentally and quickly cut into the formation creating ridges in the formation material of sufficient height to limit lateral movement of the bit and thereby avoid destruction of the cutting edges.

More specifically, invention also resides in the construction of the bit with radially adjacent cutting elements not overlapped by a cumulative maximum axial amount more than the axial length of either of the cutting elements and while still protruding axially for a distance sufficient to cut the formation with ridges formed between adjacent pairs of cutting elements to a height which will keep the bit from moving laterally when drilling.

The foregoing and other advantages of the present invention will become more apparent from the following description of the preferred embodiment when taken in conjunction with the accompanying drawings.

BEST MODE FOR CARRYING OUT THE INVENTION

Figure 1:
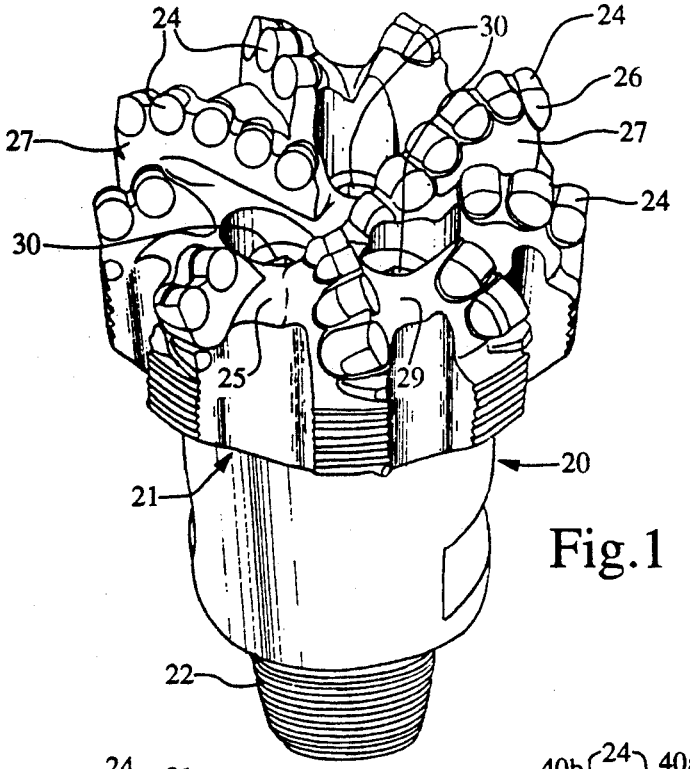
FIG. 1 is a perspective view of drill bit embodying the novel features of the present invention.

As shown in the drawings for purposes of illustration, the present invention is embodied in a fixed cutter bit such as a drag bit 20 (see FIG. 1) adapted for drilling through formations of rock to form a borehole. The bit includes a body 21 with an exteriorly threaded connection 22 at one end thereof for connection to a drill string (not shown). At the opposite end of the body, formation cutting elements 24 protrude from a face 25 for drilling through formation material when the bit is turned such as by rotation of the tubing string. Herein, the drag bit body 21 is formed in a known manner using powdered metal tungsten carbide particles and binder material to form a hard metal cast matrix. Generally, the cutting elements may be any of a number of different hard metal materials such as sintered tungsten carbide, polycrystalline diamond or natural diamonds in a matrix material.

In the illustrated embodiment of the invention, each cutting element 24 is mounted within a pocket 26 (see FIG. 2) which in turn is formed in a generally radial wing 27 (see FIG. 1). Several of the wings are formed integrally with the bit body being spaced angularly from each other in the face 25. Located between the wings are generally radially extending flow passages 29 through which drilling fluid flows to clean formation cuttings from the bottom of the borehole and between the cutting elements when drilling. The drilling fluid is delivered to the face of the bit through the drill string and a central passage (not shown) in the bit body 21 to exit nozzles 30 and wash across the face of the bit.

Figure 2:
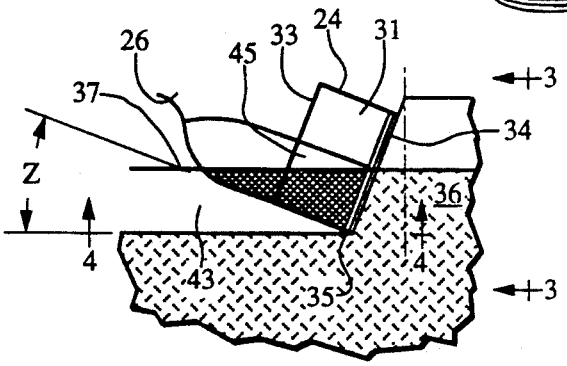
FIG. 2 is an enlarged schematic elevational view of one of the cutter elements of the bit shown in engagement with formation material during drilling.

The construction of each of the cutting elements 24 is shown in greater detail in FIG. 2 as including a cylindrical support 31 with one end 33 secured within its pocket such as by means of brazing or the like. The support itself is comprised of a sintered tungsten carbide material which is harder than the body matrix material. Attached to the other end of the support is an extremely hard layer 34 of synthetic polycrystalline diamond material. Collectively, these layers provide the major cutting surfaces for the bit. Specifically, the outwardly facing periphery of each of the layers defines a cutting edge 35 (also see FIG. 3) for shearing through the formation material to remove a layer 36 of rock formation material as weight and torque are applied through the tubing string to the bit 20 to rotate the bit under pressure against the bottom of the borehole.

In accordance with the primary aim of the present invention, the cutting elements 24 are arranged on the face 25 of the bit 20 in a unique new pattern so that the bit may drill more quickly and for a longer period of time through a wider range of different formation material harnesses. For this purpose, the cutting elements are arranged to remove formation material from the bottom of the borehole with a novel combination of drilling actions involving both shearing and fracturing of formation material across the bit face 25 to form stabilizing ridges 37 which are removed from the formation primarily without being cut by the cutting elements and without reaching the face of the bit to block the drilling fluid flow for cuttings removal.

Figure 3:
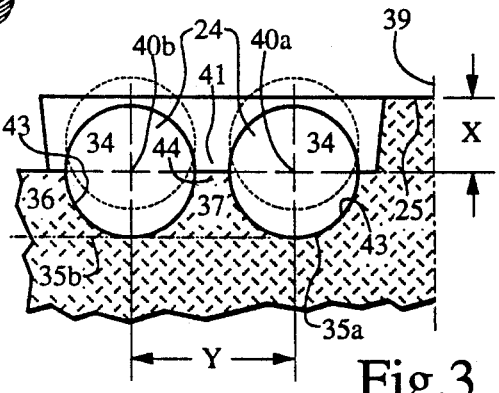
FIGS. 3 and 4 are views taken substantially along lines 3—3 and 4—4, respectively, of FIG. 2.
Figure 5:
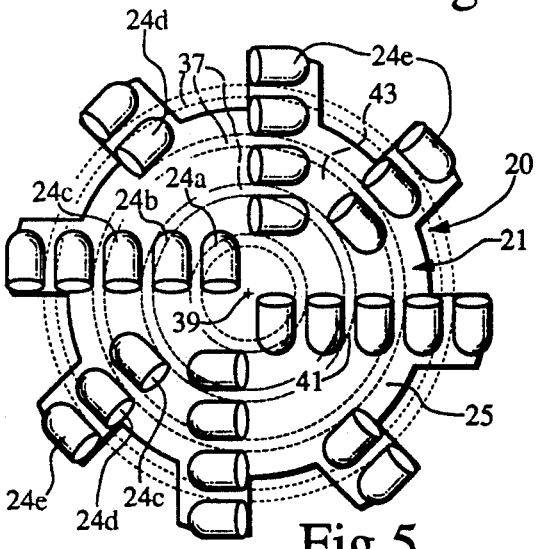
FIG. 5 is a plan view showing the arrangement of the cutting elements on the bit face with portions of the bottom hole pattern shown in dashed lines.

In a preferred form of the present invention, the cutting elements 24 are arranged in radially spaced groups 24*a*, 24*b*, 24*c*, 24*d* and 24*e* (see FIG. 5). Within each group the cutting elements are angularly spaced from each other and the number of elements in each group increases from two to eight upon progressing radially outward from a central axis 39 of the bit. Moreover, within each group midpoints 40*a*, 40*b*, (see FIG. 3) of the circular areas of the diamond layers 34 are at common radial positions relative to the axis of the bit. In the exemplary bit, the diameters of the circular areas for all of the diamond layers are the same and the midpoints thereof are spaced axially from the face 25 of the bit approximately the same distance X. As shown in FIG. 3, this distance is somewhat greater than the radius of the layer 34. From one group to the next, the distance Y between midpoints 40*a* and 40*b* of adjacent pairs of the diamond layers 34 is greater than the sum of the radii of the circular areas of adjacent layers. Thus, as best seen in FIG. 5, there are four radially spaced annular gaps 41 existing between the cutting edges 35 of the elements, one gap each being located between each adjacent pair of groups. Herein, the radial width of each such gap 41 (see FIG. 3) is equal to the shortest radial distance between the cutting edges 35*a* and 35*b* of adjacent elements. Specifically, the width of the gap is not substantially greater than the distance X.

When drilling with the foregoing bit 20, a portion of formation material at the bottom of the borehole remains uncut by the shearing action of the cutting elements 24 so that across the face 25 of the bit, alternating ridges 37 and grooves 43. As shown in FIGS. 3 and 5, the ridges are defined by pairs of the grooves 43. The bottoms of the grooves are generally circular in configuration matching the profile of the cutting edges 35*a* and 35*b* and leaving the ridge 37 with concave side walls. An apex portion 44 of the ridge 37 connects between the side walls with the ridge extending axially toward the face of the bit between the adjacent cutting elements.

In accordance with and important feature of the present invention, novel means are utilized to fracture the apex portion 44 off the ridge 37 before the apex reaches the bit face and blocks off drilling fluid flow. Advantageously, in this embodiment of the invention radially outward sides 45 of the cutting element supports 31 are utilized as the means for breaking off the apex portion of the ridge.

Figure 4:
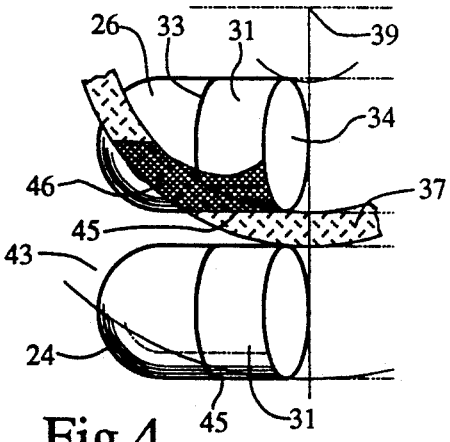

The manner in which this is achieved is shown most clearly in FIGS. 2 and 4. For each cutting element, the support 31 and diamond layer 34 are aligned longitudinally in a direction which is generally tangential (see FIG. 4) to the circular path of rotation of the bit. Additionally, the elements are longitudinally cocked with respect to vertical by an acute angle Z (see FIG. 2) within the range of five to thirty degrees (5°–30°) and preferably of about twenty degrees (20°). With this mounting arrangement, a portion of the outward side of the cutting element support rides in abutting sliding engagement with the concave inside wall of the ridge 37 along the area 46 represented by the crosshatching in FIG. 4. As a result of this engagement, it is believed at least in part that the apex 44 of the ridge is fractured off and washed away with the finer cuttings sheared from the bottom of the groove by the cutting edges 35. It is this unique combination of fracturing and shearing drilling mechanisms which is thought to contribute to the increase in penetration rates achievable with the present bit for the reasons that the fracturing off of a substantial portion of formation area being drilled is achieved more easily than with full face shearing, and that more cutting edge may be concentrated at any one radial position so that the weight on bit is in turn concentrated. An additional benefit is also thought to be achieved by virtue of utilizing the vertical height of the ridges 37 to aid in stabilizing the bit against lateral motion with the sides of the cutters and supports acting uniformly in a balanced manner when nested within the grooves 43 to resist rotational deviations.

Figure 8:
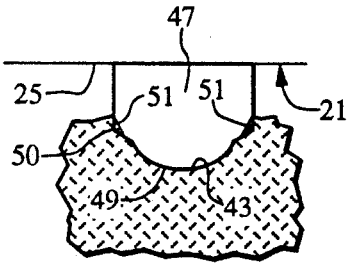
FIGS. 7 and 8 are partial cross-sectional views taken substantially along lines 7—7 and 8—8, respectively of FIG. 6.
Figure 6:
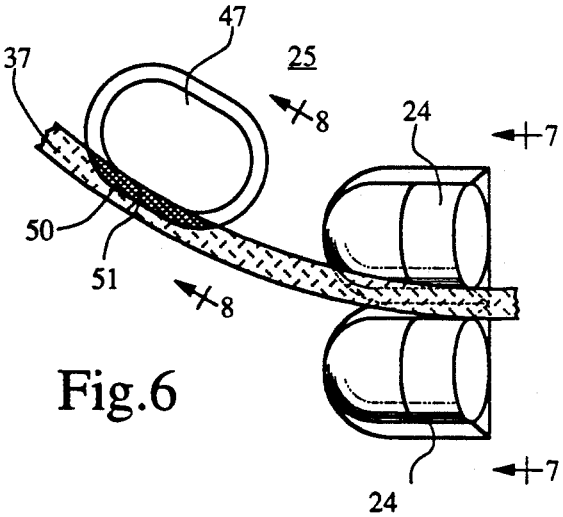
FIG. 6 is a fragmentary plan view of a portion of a bit face similar to FIG. 4 but showing an alternative version of one of the features of the present invention.
Figure 7:
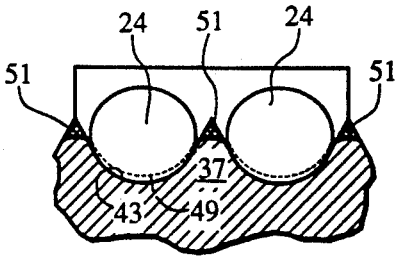

A variation of the means for removing the apex 44 of the ridge 37 is shown in FIGS. 6–8. In this form of the invention, an oblong boss 47 is formed integrally with the face 25 of the bit body 21 of the same hard metal matrix of materials and is spaced rotationally behind cutting elements 24 but at the same radial distance from the axis of the bit as one of the cutting elements. An outer surface area 49 (see FIG. 8) of the boss is configured generally complimentary to the shape of the groove 43 but with a radially outward side portion or shoulder 50 located in conflicting position with the apex portion of the ridge as represented by the double crosshatched areas 51 shown in FIGS. 6–8. Thus, as the bit is rotated the outward side portion 50 wedges against the apex 44 of the ridge breaking it off for removal from the bottom of the borehole well by the flow of drilling fluid across the face of the bit. As shown in FIGS. 6 and 8, the shoulder 50 extends completely around the periphery of the boss so that a radially inside portion of the shoulder acts against the inside ridge shown in FIG. 8.

Figure 9:
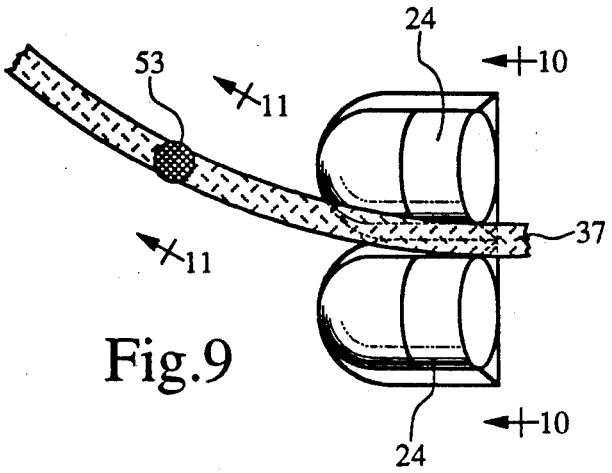
FIG. 9 is a fragmentary plan view similar to FIG. 6 but showing still another alternative version of one of the features of the present invention.
Figure 11:
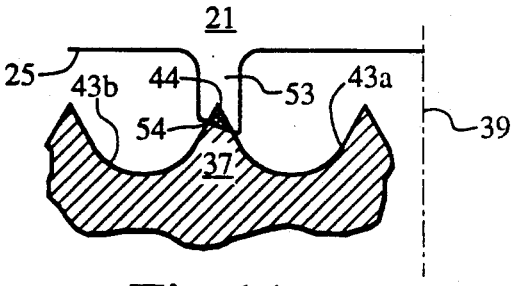
FIGS. 10 and 11 are partial cross-sectional views taken substantially along lines 10—10 and 11—11, respectively, of FIG. 9.
Figure 10:
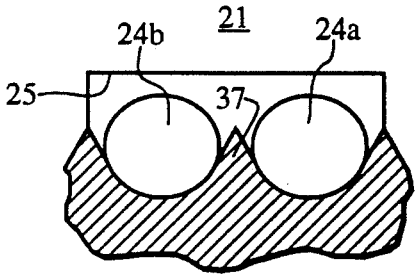

Another variation of the means for removal of the apex 44 of the ridge 37 is shown in FIGS. 9–11. In this form of the invention, a protuberance 53 of bit body matrix material integrally formed with the body 21 of the bit 20 extends axially outward from the face 25 of the bit into the path of the ridge. Specifically, the protuberance is generally cylindrical in shape and includes an outer end surface 54 (see FIG. 11) which is slanted at an acute angle with respect to the axis of the bit. More particularly, the outer end surface is slanted so as to face in a radially outward direction for engagement with the apex portion of the ridge. This apex portion is shown by the double cross-hatched area 44 in FIG. 11. Thus, as the bit is rotated into the formation material, two grooves 43*a* and 43*b* are formed (see FIGS. 10 and 11) by the cutting elements 24*a* and 24*b* with the ridge 31 therebetween. Trailing the cutting elements, the protuberance wedges against the apex portion 44 of the ridge breaking formation material radially outward to be washed away with the flow of drilling fluid across the face of the bit.

Another important feature of the present invention which is believed to be important to the lateral stability of the bit 20 when drilling is the height and width of the of the ridge 37. The ridge should be radially thick enough at some position spaced upwardly from the bottom of the groove 43 to provide a reaction surface having enough resistance against the drilling elements 24 so as to keep the bit from moving laterally during rotational drilling. On the other hand, the top of the ridge must be fractured off easily enough so that the apex 44 is kept from reaching the face 25 of the bit and possibly blocking off the flow of drilling fluid and bit failure. Thus, the ridges are formed with cutting elements 24 whose cutting edges 35 are of a greater circumferential span relative to their midpoints than for prior drag bits.

Figure 12:
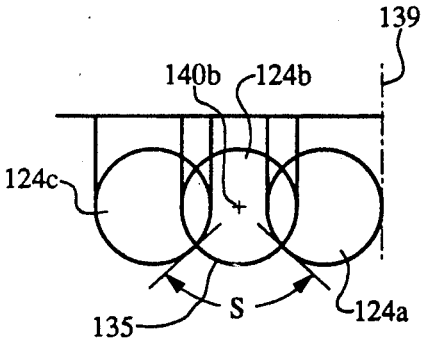
Fig.12 (PRIOR ART)
FIG. 12 is a schematic view of a portion of a prior art cutter element profile.

FIG. 12 is illustrative of the cutting edge span of a typical prior art drag bit and shows a representative rotated profile of three groups 124*a*, 124*b* and 124*c* of cutting elements. A rotated profile is simply a means of illustrating the relative radial positions of various different radial placements of the cutting elements on the face of a bit by depicting all of the positions as if rotated about the axis of the bit onto a single radial line which herein is to the left of an axis 139 of the bit. In the prior art profile shown, the arcuate span of the cutting edges 135 is generally accepted to be no greater than ninety six degrees (96°) as measured by the angle S between the formation side intersections of overlapping adjacent profiles relative to the mid-point 140*b* of the center element 124*b*.

Figure 13:
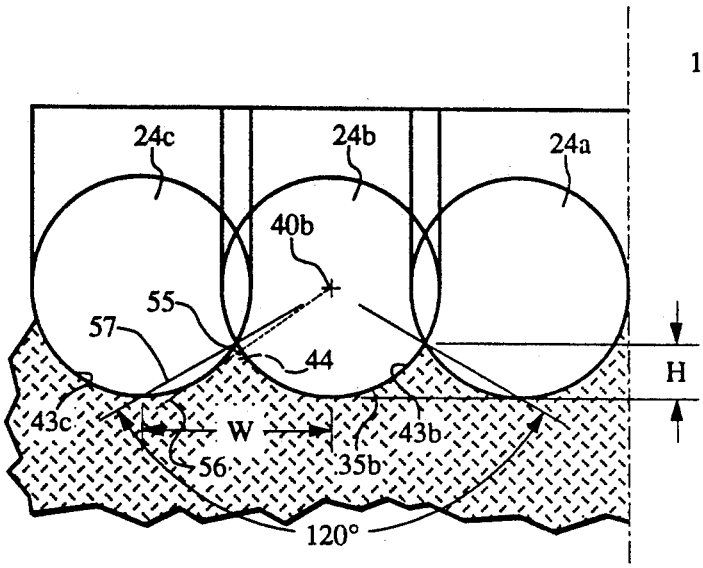
FIG. 13 is a schematic view of a portion of the cutter element profile for an alternative embodiment of a feature of the present invention.

In contrast to the prior art arrangement shown in FIG. 12, the improved bit 20 of the present invention contemplates a minimum arcuate span of one hundred-twenty degrees (120°) for the cutting edge 35*b*. As shown more specifically in FIG. 13, the effect of this improved radial spacing relationship between the profiles of the cutting edges is a increased width W of the base of the ridge 37 created between adjacent cutting elements 35 and a related increase in height. As shown in FIG. 13, the H height of the ridge 37 is approximately one fifth of the diameter of the cutting element 24. More importantly, it is believed that the apex portion 44 of the ridge is removed from the formation more by the aforementioned easier fracturing mechanism than by the shearing mechanism that occurs along the lower most portion of the cutting edge. The rational behind this belief is that the degree to which shearing occurs is directly related to the weight applied through the drill string onto the cutting edges of the elements. Penetration of the cutting edge into the formation material depends upon the loading normal to the cutting edge. As the normal to cutting edge changes from being generally vertical to horizontal, the forces resisting penetration are correspondingly changed and, with the narrowing width of the ridge the formation becomes weaker and more easily fractured off. This is particularly true, for example, once the normal to the cutting edge of the center cutting element is a chordwise intersection of the adjacent cutting elements.

As shown in FIG. 13, a small generally triangular area 55 is defined in the ridge between dashed and solid normal load lines 56 and 57, respectively. The dashed normal line 56 is tangent to the bottom of the groove 43*c* and the solid normal line intersects the lower overlap of the cutting edge profiles 35*b* and 35*c*. As may be readily seen in FIG. 13, the ridge area 55 is unsupported by formation material and is susceptible to being broken from the remaining portion of the ridge by cutting element 24*b*. Similarly, a mirror image portion (not shown) of the shaded area 55 on the apex 44 of the ridge 37 may be broken off by the action of the radially outermost cutting element 24*c*. Thus, the apex is susceptible to being fractured in both radial directions leaving a lower unfractured ridge of sufficient height and width for supporting the bit against lateral movement.

Figure 14:
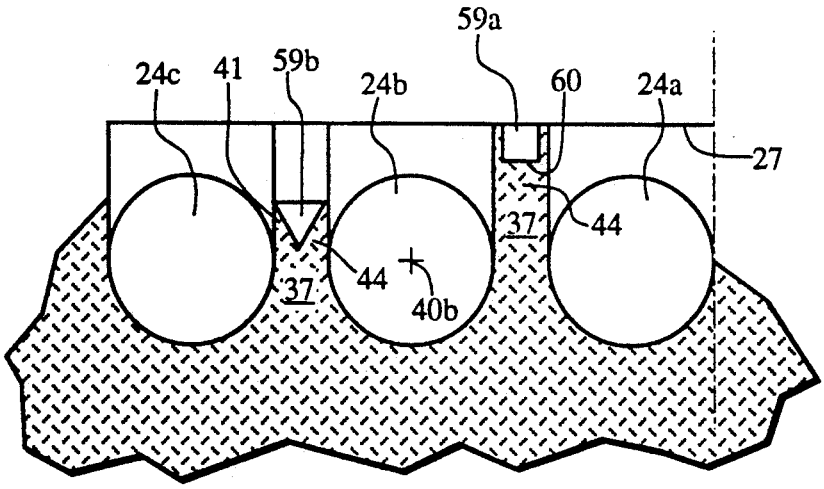
FIG. 14 is a combined schematic view similar to FIG. 13 but showing portions of two different cutting element profiles of alternative arrangements of another feature of the present invention.

Another alternate feature of the present invention is illustrated in FIG. 14 wherein secondary cutting elements 59 are mounted on the face 25 of the bit 20 to insure removal of the apex 44 of the ridge 37. Specifically, the secondary cutting elements are formed of a hard metal material such as sintered tungsten carbide and, in profile, are mounted entirely within the gaps 41 between each adjacent pair of primary cutting elements 24 on the surface of the wings 27. Two different types of secondary cutting elements 59*a* and 59*b* are shown in FIG. 14. The element 59*b* is of the scribe type while the element 59*a* is provided with a square cutting edge 60. Importantly, the secondary cutting elements protrude from the face of the bit a distance no greater than the distance X from the face of the bit to the midpoint 40*b* of the primary cutting element 24*b*. In service use of the bit, the secondary cutting elements provide a mechanism for insuring removal of the fractured apex 44 so that formation cuttings from the ridge are deflected and kept from excessively wearing the wing material between adjacent primary cutting elements.

Thus, it is seen from the foregoing that the present invention brings to the art a unique fixed cutter bit 20 which is particularly adapted for transitional drilling by the arrangement of the primary cutting elements 24 so as to leave a gap 41 in the bit profile. During drilling, the gap causes the formation of the ridge 37 which remains uncut from the bottom of the hole but which is instead fractured off and then washed across the face of the bit to be carried to the surface with the drilling fluid.

We claim:

1. In a drill bit having a plurality of primary polycrystalline diamond cutting elements supported within the body of the bit and protruding from the face thereof for the cutting edges of said elements to cut through the material in a formation when the bit is rotated about its comprising said cutting elements being located relative to the axis of the bit in a predefined pattern so that when drilling, said elements cut the formation material to produce a plurality of concentrically alternating grooves and ridges in the bottom of the well, each of said ridges having an apex portion disposed between said cutting elements, and each said apex portion remaining out of cutting engagement with the cutting edges of the cutting elements and being removed from the ridge as the bit progresses through the formation before the apex contacts the face of the bit said improvement further being defined by support members connected between said cutting edges and said bit body, said support members each including a side surface extending in a generally annular direction relative to the axis of said bit and engageable with said ridge as said bit is rotated during drilling to aid in the removal of said apex from said ridge as the bit progresses through the formation.

2. A drill bit as defined by claim 1 wherein said cutting elements are located in first and second groups, said first group including at least two cutting elements located along a first circular path of rotational travel about said bit axis, said cutting elements in said first group each having a first cutting edge portion thereof designed for removing material from said formation and located on said first circular path so as to cut a first groove in said formation material upon repeated rotation of said bit;

said second group including at least two cutting elements located along a second circular path of rotational travel about said bit axis, said cutting elements in said second group each having a second cutting edge portion thereof designed for removing material from said formation and located on said second circular path so as to cut a second groove in said formation material upon repeated rotation of said bit;

said second circular path being spaced radially outside of said first circular path a sufficient distance so that said cutting elements in said first and second groups create said first and second grooves spaced apart from each other leaving a first ridge of said formation material therebetween, said ridge extending in an axial direction between said first and second groups of cutting elements and having a said apex portion and a base portion extending axially between said first and second grooves;

said apex portion being broken off from said base portion during drilling independently of cutting by said cutting edges and leaving said base portion for reacting against said support members so as to resist lateral movement of said bit within said borehole and maintain said axis of rotation in a stable position.

3. A fixed cutter bit for use on the end of a drill string to cut through formation material at the bottom of a borehole, said bit comprising a body having a rotational axis and first and second ends;

a connection at said first end of said body for securing said body to said drill string;

a face at said second end to be positioned adjacent said bottom of said borehole when drilling;

a first group of at least two cutting elements each connected to said body and protruding from said face, said first group of said cutting elements being located along a first circular path of rotational travel about said bit axis, said cutting elements in said first group each having a first cutting edge portion thereof designed for removing material from said formation and located on said first circular path so as to cut a first groove in said formation material upon repeated rotation of said bit;

a second group of at least two cutting elements each connected to said body and protruding from said face, said second group of said cutting elements being located along a second circular path of rotational travel about said bit axis, said cutting elements in said second group each having a second cutting edge portion thereof designed for removing material from said formation and located on said second circular path so as to cut a second groove in said formation material upon repeated rotation of said bit;

said second circular path being spaced radially outside of said first circular path a sufficient distance so that said cutting elements in said first and second groups create said first and second grooves spaced apart from each other leaving a ridge of said formation material therebetween, said ridge extending in an axial direction between said first and second groups of cutting elements and having a base portion extending axially between said first and second grooves to react with said cutting elements to resist lateral movement of said bit within said borehole and maintain said axis of rotation in a stable position, and said ridge further having an apex portion integral with said base portion and extending in an axial direction therefrom toward said bit face between said cutting edge portions of said first and second groups; and means on said bit face located between said first and second circular paths and positioned to act against said ridge to remove said apex portion independent from the cutting action engagement of the cutting edge portions of said cutting elements and before said apex engages said bit face.

4. A fixed cutter drill bit as defined by claim 3, further comprising a layer of polycrystalline diamond material on each of said cutting elements in said first and said second groups, said first and second cutting edge portions being formed on said layers and being spaced from the face of the bit at substantially similar distances, each of said layers having a midpoint spaced from its cutting edge toward said bit face, and said sufficient distance of said second circular path outside of said first circular path defining a gap having a width which is not substantially greater than either of the distances measured from said midpoints to the face of the bit body.

5. In the drill bit as defined by claim 4, the improvement further comprising secondary cutting elements disposed on the face of said bit and recessed toward the face of bit from the cutting edges of said layers, said secondary cutting elements being disposed within said gap.

6. In the drill bit as defined by claim 5, the improvement further including said secondary cutting edges having a radially extending width not substantially greater than the width of said gap.

7. In the drill bit as defined by claim 5, the improvement further being defined as including a third group of said cutting elements, said third group of elements being spaced radially from both said first and second groups of cutting elements and associated with at least one of said first and second groups of cutting elements to define a second gap therebetween, said second gap causing a second portion of the formation material to remain uncut by said elements during drilling and thereby forming a second ridge with a second apex extending between said third group and said associated one of said first and second groups of cutting elements, said cutting elements in one of said groups acting against said second ridge to remove said second apex portion thereof substantially without cutting action engagement of the cutting edge portions of said cutting elements and before the apex of said second ridge engages the face of the bit.

8. In a drill bit as defined by claim 7, the improvement further being defined by said cutting edges of said elements being arcuate whereby each of said ridges is formed with a concave radially inward sidewall and a concave radially outward sidewall, with the apex of said ridge joining said sidewalls.

9. A fixed cutter drill bit as defined by claim 3 including supports attached to the bit body, one of said supports for each of the cutting elements, said supports being included in said means to act against said ridge to remove said apex portion.

10. A fixed cutter drill bit as defined by claim 3 with supports attached to the bit body, one of said supports for each of the cutting elements, said supports extending from the face of said bit for engagement with said ridge whereby said bit is kept from moving laterally within the well when drilling.

11. A fixed cutter drill bit as defined by claim 3 further comprising a plurality of secondary cutting elements supported within said body and located relative to said first and second groups of cutting elements between said first and second circular paths for axial alignment with said ridges, said secondary cutting elements having a cutting edges spaced axially toward said bit face from said cutting element cutting edges in said first and second groups by a preselected distance, said secondary cutting edges engaging and cutting said ridges during drilling to remove the apexes thereof before said apexes reach the bit face, said preselected distance being sufficient for said secondary cutting elements to form said ridges to an axial height sufficient to keep said the drill bit from moving laterally during drilling.

12. A fixed cutter drill bit as defined by claim 3 such that in profile radially adjacent ones of cutting edge portions of said first and second groups of cutting elements taper generally toward each other upon progressing in an axial direction toward said bit face from the outermost points on said adjacent cutting edge portions relative to said bit face so that said ridge is formed with a base portion which is wider than said apex.

13. In a drill bit as defined by claim 12 wherein said sufficient distance of said second circular path outside of said first circular path defines a gap, said means to act against said ridge to remove said apex includes a surface on a hard metal matrix member integrally formed with said bit body and disposed in profile within said gap for engagement with said apex during drilling to remove said apex from said ridge.

14. In a drill bit as defined by claim 13, said member comprising a protuberance protruding from said bit body at a radial position within said gap and wherein said surface is formed on an outer end of said protuberance, said surface being slanted in to face in a radially outward direction.

15. In a drill bit as defined by claim 13, said member comprising a generally oblong boss protruding from said bit body at a generally radial position circumferentially aligned with one of said groups of cutting elements, said boss extending into a groove cut into the formation material by said one group of cutting elements and including at least one shoulder integrally formed therewith and said surface being a portion of said shoulder and extending radially into interfering engagement with said apex.

16. In the drill bit as defined by claim 13 with supports attached to the bit body, one of said supports for each of the cutting elements, the improvement further comprising the utilization of the supports as at least a portion of said means to act against said ridge and remove said apex.

17. A bit as defined by claim 3 wherein said first and second groups of cutting elements are two of a number of said groups of said cutting elements protruding from said bit face, said groups being located along an equal number of radially spaced circular paths of rotational travel about said bit axis to cut an equal number of grooves in said formation material in said bottom of said borehole leaving a ridge between adjacent ones of said grooves, and all of said cutting elements on said bit face for cutting said bottom of said borehole being in two or more of said groups.

18. A bit as defined by claim 17 wherein said means to act against said ridge includes a surface positioned to wedge against and break off said apex from said base as said bit is rotated about its axis.

* * * * *